United States Patent [19]

Macy et al.

[11] 4,028,816

[45] June 14, 1977

[54] FOOD DRYER

[76] Inventors: Frank D. Macy, 420 S. Holly, Canby, Oreg. 97013; Harold E. Hawthorne, 401 N. James; Harold L. Norton, Rte. 1, Box 291B, both of Silverton, Oreg. 97381

[22] Filed: Dec. 12, 1975

[21] Appl. No.: 640,178

[52] U.S. Cl. ..... 34/195; 34/233; 34/238

[51] Int. Cl.[2] ..... F26B 11/18

[58] Field of Search ..... 34/192–198, 34/201, 233, 238, 239; 126/21 A, 190; 219/400; 99/447, 448, 468, 476, 483

[56] References Cited

UNITED STATES PATENTS

| | | | |
|---|---|---|---|
| 2,017,728 | 10/1935 | Oskamp | 34/196 |
| 2,410,129 | 10/1946 | Phelps | 34/238 |
| 2,487,722 | 11/1949 | Newell | 34/233 |
| 3,513,567 | 5/1970 | Paul | 34/233 |
| 3,553,425 | 1/1971 | Fry | 126/190 |

*Primary Examiner*—Kenneth W. Sprague
*Assistant Examiner*—James C. Yeung
*Attorney, Agent, or Firm*—James D. Givnan, Jr.

[57] ABSTRACT

A food dryer cabinet closed at one end by a door offset from the cabinet end providing an air space therebetween through which an exhaust flow passes. Hinge elements and a latch assembly cooperate to offset the door from the cabinet end. An electrical component housing of noncombustible material occupies the opposite end of the cabinet and isolates dryer electrical components from the cabinet for safety purposes. A plate member constitutes the back wall of the cabinet while additionally serving to secure the noncombustible component housing within the cabinet. A metal mesh member closes the housing and supports a baffle for desired air flow over the food articles being dried.

5 Claims, 4 Drawing Figures

FOOD DRYER

BACKGROUND OF THE INVENTION

The present invention concerns food dryers or dehydrators of the type used within the home for drying a varied assortment of food articles.

Prior food dehydrators utilize various intake and exhaust arrangements to promote a flow of heated air past the articles being dried. A number of food dryers recirculate at least a portion of the drying air and include adjustable vent means for varying the proportion of recirculated air to the intake of ambient air. The recirculation of moisture laden air slows the drying operation as moisture content and drying characteristics are inversely related.

The venting arrangements found in prior art dryers as restricted in area by the physical dimensions of the dryer and often are unable to adequately exhaust air from a dryer. Accordingly, both the heat source and fan assembly in prior art dryers must be of a capacity to accomplish drying with air having a higher than desired mositure content. Such dryer components add substantially to dryer manufacturing costs.

A further drawback to known dryers resides in the same constituting a fire hazard by reason of the dryer cabinet being manufactured from wooden components which are subjected to long periods of high temperatures and exposed to heating coils and related wiring. For the most part electrical components are typically mounted individually into the dryer cabinet which is of limited internal area making such work an arduous, time consuming task.

SUMMARY OF THE PRESENT INVENTION

The food dryer embodying the present invention is closed at one of its ends by a door which, when latched to the dryer cabinet, defines with said cabinet an air vent. Dryer air impinging against the inner surface of the door is diverted outwardly for escape thereby diminishing, to a large extent, the recirculation of moist air within the dryer cabinet. Electrical components are assembled in a compartmented manner within a fire resistant housing which is inserted intact into one end of the dryer cabinet during dryer manufacture. Said housing isolates the electrical components from wooden structural members of the cabinet body to greatly reduce the chance of dryer fire. From a manufacturing standpoint, dryer assembly time is reduced by reason of the fact that electrical components are installed and wired in assembly line fashion as opposed to the worker having to install same individually within the restricted internal area of the dryer. Similarly access to the electrical components is facilitated as the component housing may be extracted from the dryer simply by the removal of fastener elements.

Important objects of the present invention include: the provision of a food dryer wherein the door and dryer cabinet jointly define an exhaust vent opening therebetween to permit discharge of a high proportion of dryer air; the provision of a dryer having electrical components assembled within a metallic housing module insertable into one end of the dryer cabinet thereby precluding the difficult task of installing electrical components one at a time within the dryer; the provision of a food dryer wherein all electrical components are shielded from contact with combustible cabinet components; and the provision of a food dryer utilizing a baffle plate supported upon a reticulated section to provide a diffused flow of heated air from a heater element prior to flow over the food articles.

BRIEF DESCRIPTION OF THE DRAWINGS

In the accompanying drawings

DETAILED DESCRIPTION OF THE PREFERRED EMBODIMENT

Figure 1:
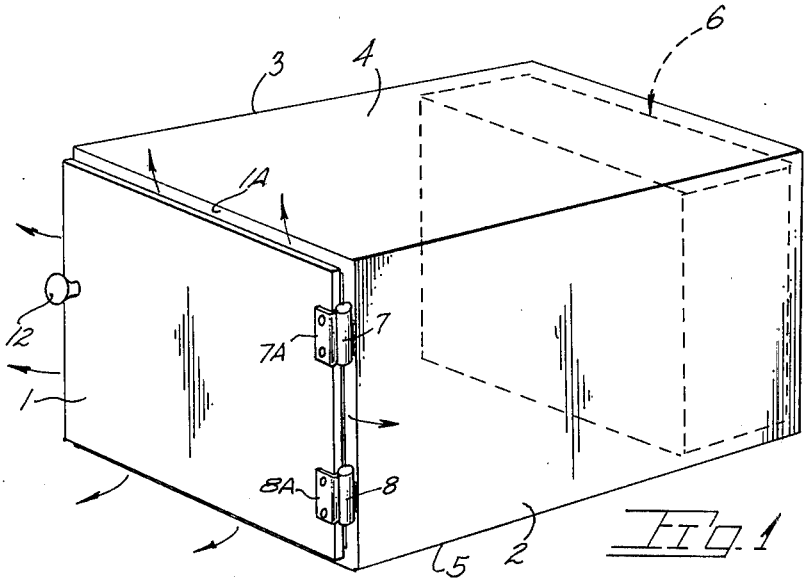
FIG. 1 is a perspective view of a food dryer embodying the instant invention.

With continuing reference to the accompanying drawings wherein applied reference numerals indicate parts similarly identified in the following specification, the reference numeral 1 indicates a dryer door in outwardly spaced relationship to the frontal edge of a dryer cabinet which is of box-like construction having side walls 2 and 3, with top and bottom walls 4 and 5. Indicated generally at 6 is an electrical component housing module in place within the rearward end of the cabinet.

Figure 2:
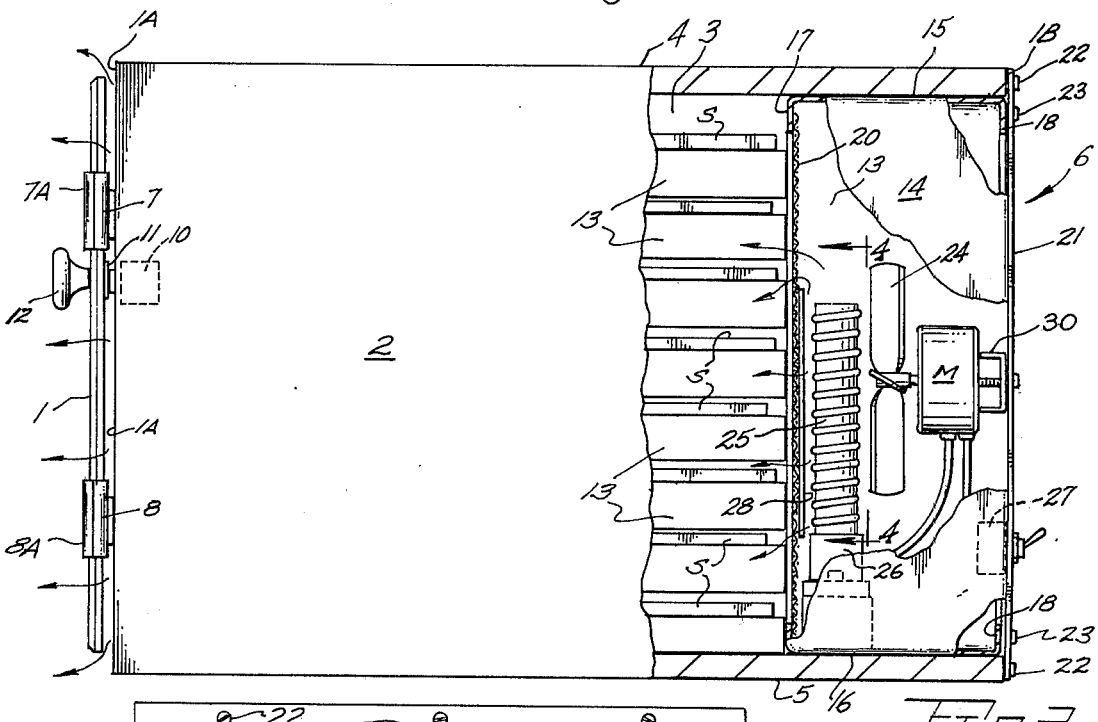
FIG. 2 is a side elevational view of the dryer.
Figure 3:
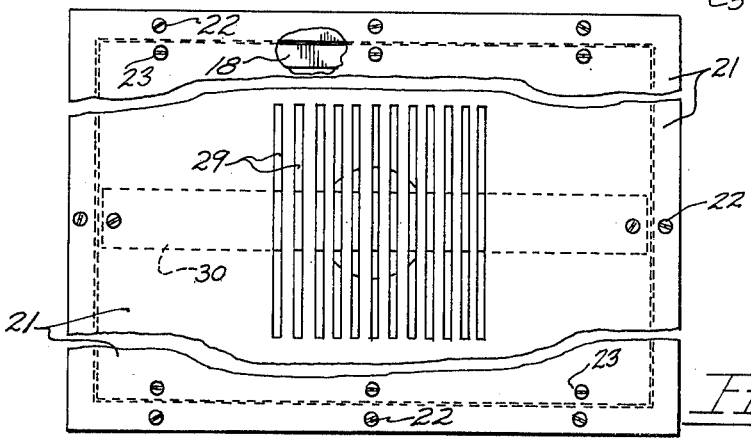
FIG. 3 is a rear elevational view sectioned for illustrative purposes.

Door 1 is hingedly mounted to the frontal edge of the cabinet by hinge members 7 and 8 each including a door mounted strap component 7A, 8A each component configured so as to locate door 1 in forwardly offset relationship to frontal edge 1A of the cabinet. A latch 10, preferably magnetic, cooperates with a door mounted latch plate 11 to maintain the above noted offset relationship when the door is closed. A pull 12 may be conveniently provided as part of the latch. Remaining strap components of the hinges are affixed to the frontal edge 1A of the cabinet. Applied arrows in FIGS. 1 and 2 indicate an escaping air flow which, as aforesaid, passes intermediate cabinet perimeter 1A and the offset edge of door 1. To enable viewing of the food articles being dried, door 1 may be of a durable transparent plastic material.

In place along the side wall surfaces of the cabinet are elongate shelf supports 13 each opposing pair of which support a shelf S which desirably is of screen material permitting air to pass therethrough. The shelf supports terminate rearwardly in the proximity of the frontal edge of electrical component housing 6 which is of formed sheet metal construction.

Component housing 6 includes side walls 13 and 14 with intermediate top and bottom walls at 15 and 16. Front and rear inwardly directed perimetrical flanges are indicated at 17 and 18. Flange 17 supports a screen 20 which fully occupies the area defined by front flange 17. Closing the back side of component housing 6 is a metal plate 21, slotted at 21A to provide an air intake, which plate is secured to the rearward edge 1B of the cabinet by threaded fasteners 22. Additional fasteners at 23 serve to attach plate 21 to rear housing flange 18 thereby providing a unitary housing structure for convenient installation within the cabinet. The screen 20, housing walls 13 through 16 and plate 21 serve to isolate the following described electrical components from the wooden cabinet.

Electrical components of the dryer include a motor M driving a fan blade 24, the latter moving a flow of air past centrally disposed heater coils and holder 25 mounted within a socket 26. An off-on switch 27 controls circuit closure to heater 25 and motor M which circuit may include a thermostat responsive to dryer temperatures. Motor M is rigidly supported by a channel shaped member 30 affixed in place on plate 21 while intake openings 29 in the plate admit an air flow to the cabinet interior.

Figure 4:
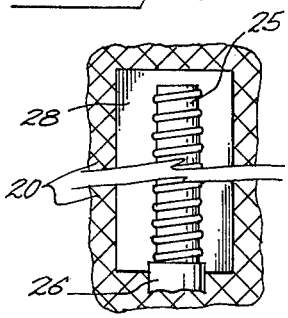
FIG. 4 is an elevational view taken along line 4—4 of FIG. 2 and sectioned for purposes of illustration.

Screen 20 serves to support a baffle 28, best viewed in FIG. 4, which serves to disperse heated air outwardly to prevent direct impingement of same upon certain articles being dried. Baffle 28 may be spot welded or otherwise suitably affixed to screen 20 to receive fan driven air moving past heater 25.

In operation, the offset door permits unobstructed discharge of dryer air along all four cabinet front edges. Drying time is lessened by reason of drying air having a low moisture content in comparison to prior art dryers which rely on recirculated air. In addition to enhancing convenient assembly during dryer manufacture, the housing 6 permits access to electrical components by simply removal of rear plate 21. Of great importance is the isolation of electrical components from the cabinet walls permitting the latter to be of wood without consequent risk of fire.

While we have shown but one embodiment of the invention it will be apparent to those skilled in the art that the invention may be embodied still otherwise without departing from the spirit and scope of the invention.

Having thus described the invention what is desired to be secured under a Letters Patent is:

1. A food dryer comprising in combination, a dryer cabinet, a door supported by the front end of said cabinet, means mounting the door to said front end of said cabinet in a uniformly offset manner to provide an exhaust passageway extending about the door edges, and a noncombustible housing module fully occupying the rearward end of said cabinet, said housing adapted to mount electrical components including a fan and motor of the dryer in a manner isolating said components from the cabinet, said housing having a reticulated closure at its forward end.

2. The dryer claimed in claim 1 wherein said mounting means comprises hinge members and a latch component serving to maintain the door in offset spaced relationship to the cabinet front end.

3. The dryer claimed in claim 1 wherein said noncombustible housing module includes continuous top, bottom and side walls and front and rear perimetrical flanges.

4. The dryer claimed in claim 3 additionally including a plate mounted to the rearward end of said housing module and closing the rearward end of said cabinet and having marginal areas overlying the rear edge of the cabinet enabling securement thereto by removable fasteners.

5. The dryer claimed in claim 4 additionally including a baffle supported by said reticulated closure for dispersal of a heated air flow.

* * * * *